United States Patent [19]

Murakami

[11] 4,382,347

[45] May 10, 1983

[54] TOY TRACTOR ASSEMBLY

[75] Inventor: Kazuya Murakami, Tokyo, Japan

[73] Assignee: Takara Co., Ltd., Osaka, Japan

[21] Appl. No.: 288,949

[22] Filed: Jul. 31, 1981

[51] Int. Cl.[3] ..... A63H 17/04

[52] U.S. Cl. ..... 46/219; 46/202; 46/201

[58] Field of Search ..... 46/219, 201, 202, 251, 46/206, 17, 111, 112, 215, 124

[56] References Cited

U.S. PATENT DOCUMENTS

| | | | |
|---|---|---|---|
| 2,735,221 | 2/1956 | Fields | 46/202 |
| 3,300,894 | 1/1967 | Glass et al. | 46/202 X |
| 4,236,345 | 12/1980 | Inoue | 46/202 X |
| 4,244,144 | 1/1981 | Goldberg et al. | 46/116 |
| 4,249,339 | 2/1981 | Crain et al. | 46/111 |

FOREIGN PATENT DOCUMENTS

| | | | |
|---|---|---|---|
| 1483751 | 8/1977 | United Kingdom | 46/202 |
| 2060414 | 5/1981 | United Kingdom | 46/201 |

*Primary Examiner*—Mickey Yu

*Attorney, Agent, or Firm*—Jackson, Jones & Price

[57] ABSTRACT

A vehicle toy assembly is provided having the capability of being reconfigured through a time control action into a second configuration. During the transformation, projectiles can be fired and a miniaturized vehicle can be released and propelled from the toy assembly.

11 Claims, 4 Drawing Figures

FIG. 1
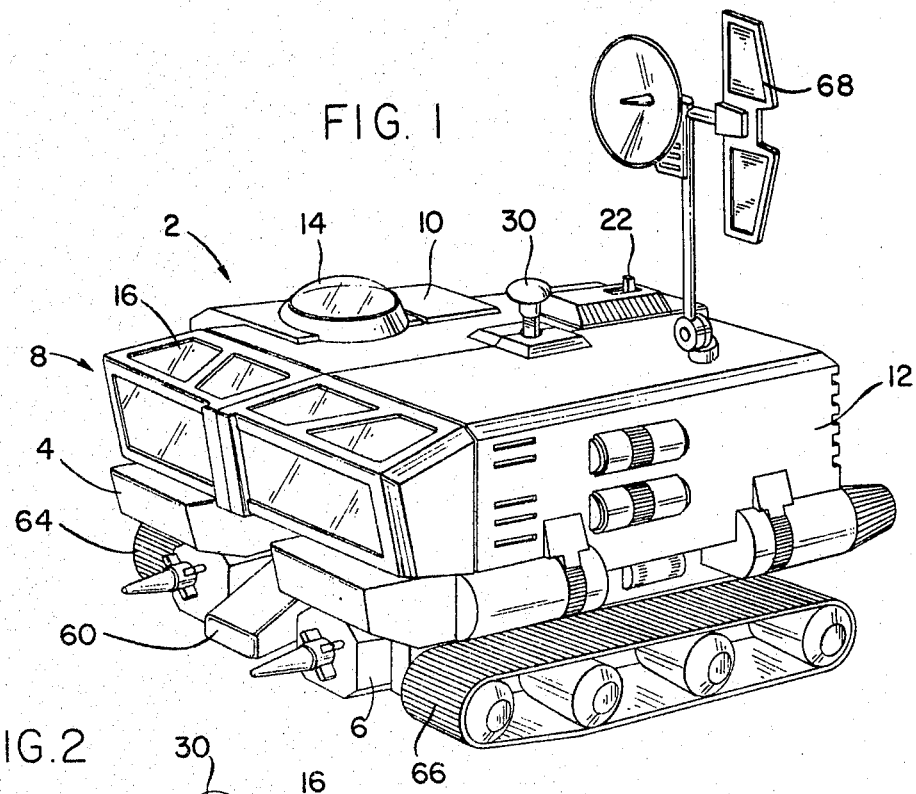
FIG. 2
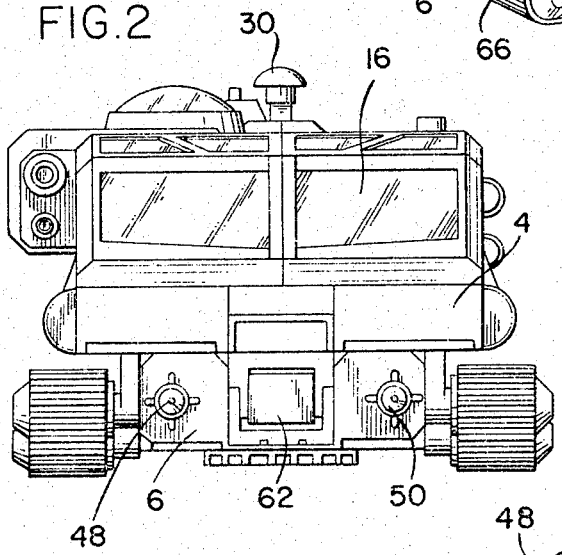
FIG. 3
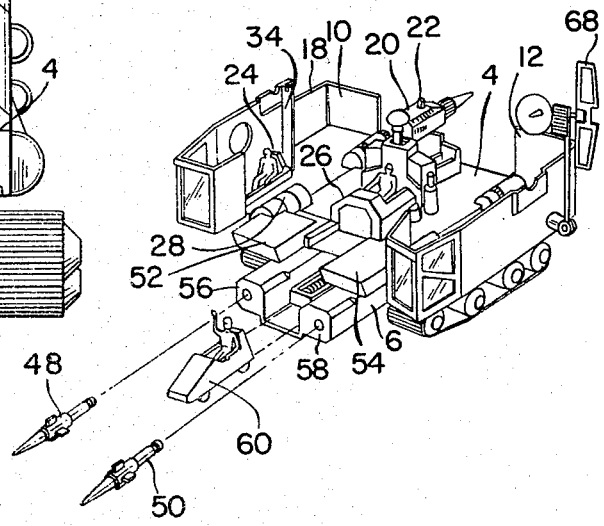
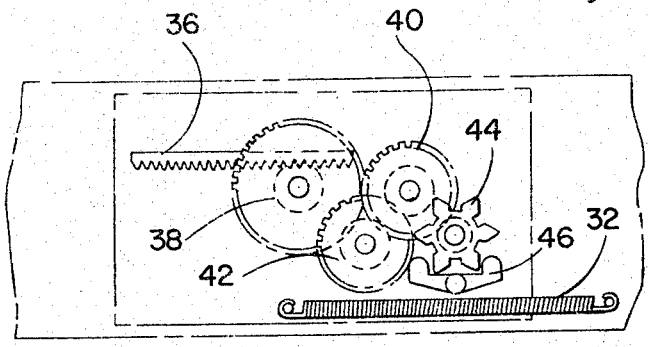
FIG. 4

TOY TRACTOR ASSEMBLY

BACKGROUND OF THE INVENTION

1. Field of the Invention

The present invention is directed to the toy industry, and more particularly to a futuristic space vehicle toy assembly capable of simulating a vehicle of the type which would permit humans to operate in an alien environment.

2. Description of the Prior Art

The toy industry has provided a large number of various designed mobile toys for use by children, including numerous examples of futuristic space type toys offering various play options. An example of such toy is U.S. Pat. No. 4,236,345 that provides a vehicle toy in the simulated configuration of a rocket ship having the capability of propelling a small vehicle member and simulated toy rocket projectiles from the vehicle by air pressure. Another example of a space-like toy that permits reconfiguration of its wall members to provide added toy options to the child is disclosed in U.S. Pat. No. 4,090,321.

The ability of these prior art toys to entertain children have been established. However, there is still a demand in the toy industry to increase the novelty and play options available to a child, such as that provided by the present invention.

SUMMARY OF THE INVENTION

The present invention provides a toy assembly that is configured to simulate a futuristic space toy. The toy assembly includes a base member which supports an upper housing member having movable walls. The walls can be reconfigured to provide an encapsulated space that simulates a control compartment for operators or can be expanded to provide an open command room with individual work areas for toy figures. A lower housing member is connected to the base member and is spring biased for relative movement into and out of the base member. Various forms of projectiles, such as miniature vehicles and simulated toy rockets, are mounted on the lower housing member and can be automatically fired upon movement out of the base member. A timing mechanism provides a controlled movement of the lower housing member out of the base member over a predetermined period of time.

While various configurations of the mobile toy assembly are possible, the preferred embodiment is in the form of a rectangular tractor toy simulating equipment for operation on hostile environments to human inhabitants.

The objects and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is a perspective view of a mobile toy assembly of the present invention;

FIG. 2 is a front view of the toy assembly;

FIG. 3 is a perspective view disclosing the projection of the toy rockets and vehicle;

FIG. 4 is a schematic plan view of the timing mechanism employed in the present invention.

DESCRIPTION OF THE PREFERRED EMBODIMENT

The following description is provided to enable any person skilled in the toy industry to make and use the invention and sets forth the best mode contemplated by the inventor for carrying out his invention. Various modifications, however, will remain readily apparent to those skilled in the toy industry, since the generic principles of the present invention have been defined herein specifically to provide a relatively economical and easily manufactured mobile toy assembly capable of projecting a plurality of projectiles.

Referring to FIG. 1, a perspective view of a mobile toy assembly 2 having a simulated space tractor configuration is disclosed. The vehicle includes a base member 4 that supports a lower housing member 6 and an upper housing member 8. The upper housing member is bifurcated into a pair of movable wall members 10 and 12. The respective wall members can have appropriate outside indicia to enhance the simulation of a space vehicle, such as a viewing bubble window 14 and a control observation cab 16. As can be readily appreciated, most of the toy parts are preferably formed from molded plastic and are susceptible to numerous subjective configurations to enhance the space theme of the toy. The movable wall members 10 and 12 have a partial J-shaped cross sectional configuration with the forward half of each wall member creating the control observation cab 16. Wall member 10 further has a rear notched portion 18 which permits clearance for the upper half of a projectile firing space gun 20. The gun 20 can be mounted for optional elevation and rotation.

The mechanism by which this gun 20 fires projectiles can be of the same type disclosed in U.S. Pat. No. 4,206,564 and that disclosure is incorporated herein by reference to supplement the present specification. Basically, a cammed lever is spring-biased with a hook-shaped portion interfacing with a notch on a simulated toy missile. The release of the lever permits the spring energy to project the missile outward. The control portion of the lever is disclosed as element 22 in the drawing.

Individual work stations 24 and 26 can be subjectively provided on both the upper surface of the base member 4 and on each of the movable walls 10 and 12. These work stations provide an additional play value when the movable wall members are extended outward, as shown in FIG. 3. The wall members themselves are biased to this extended open position by coil springs 28 such as mounted at their pivotal connections along the respective parallel edges of the base member 4.

A spring-biased actuator 30 extends downward through the base member 4 and provides a catch or keeper for respectively both of the upper movable wall members 10 and 12 and also for the lower housing member 6. The respective fastening of the movable wall members 10 and 12 against the bias of their coil springs and the lower housing member 6 against the bias of its spring 32 can be of a conventional type known in the toy industry. For example, a notch on the rib 34 of wall member 10 is designed to interface with a catch member activated by the lever 30. When the lever 30 is depressed, the catch member is released from the notch and the respective wall member 10 is immediately expanded outward into the configuration shown in FIG.

3. The base member 4 further mounts a pair of tractor treads 64 and 66 for locomotion. Additionally, there are accouterments or appendages, such as the radar staff 68, which can be removably attached to both the interior and exterior surfaces of the toy vehicle.

When the lower housing member 6 is released by the actuator lever 30, a timing mechanism is activated which includes a geared rack member 36 that is integrally molded in plastic along with the remainder of lower housing member 6. The rack member can actually be mounted on either the lower housing member 6 or on the base member 4. This rack member 36 is positioned on the interior surface of the base member 4 to interface with a lower combination pinion and drive gear 38 extending upward from the internal upper surface of the lower housing member 6. A series of combined drive gears and pinion gears that are integrally molded together to form a unitary gear member, such as members 40 and 42, provide a gear reduction and eventually drive a pinion gear attached to a starred cam configuration 44.

A follower release or escape member 46 is pivotally mounted to sequentially start and stop the movement of the cam gear 44 to provide a predetermined time period for releasing the energy stored in spring 32. This particular arrangement of the rack and pinion with the gear transmission assembly and escape mechanism conveniently provides a timed control release whereby the lower housing member 6 will require approximately five seconds for complete activation to assume the configuration shown in FIG. 3. The actual perception by the child of this reconfiguration is that the toy device is more than simply spring-biased, since the escape mechanism provides a whirring sound and the slow release of the spring energy gives the impression that it is a battery driven electric toy of considerably more cost. Additionally, this timed release provides an opportunity for the movable wall members 10 and 12 to assume the position disclosed in FIG. 3 while the lower housing member 6 is gradually extending from the base member 4. Part way through this movement, the rocket missiles 48 and 50 have been fired as a result of a camming action of the abutment members 52 and 54, respectively, against the firing levers 56 and 58.

The construction of the lower housing member firing mechanism is similar to that described above with regard to the projectile gun 20. In a similar mode of operation, a miniature vehicle 60 is likewise ejected, for example, immediately subsequent to the firing of the pair of rocket missiles 48 and 50. A spring-biased plunger 62 is released in a similar manner by the movement of the lower housing member 6 out of the base member 4.

In operation, the respective movable wall members 10 and 12 of the upper housing member 8 are fastened together to create a closed rectangular box-like vehicle configuration. Likewise, the lower housing member 6 has been loaded with the rocket missiles 48 and 50 and the miniature vehicle 60, and has been retracted into the base member 4 against the force of spring 32. The configuration of the toy as disclosed in FIG. 1 is capable of play action by the child with locomotion across a support surface by virtue of the tractor treads 64 that include rollers and an endless serrated rubber looped member.

When the child wishes to provide the toy action as disclosed in FIG. 3, he activates the actuator lever 30 which immediately releases the pair of movable wall members 10 and 12 that are expanded outward to their horizontal position. As a result, the upper surface of the base member 4 is exposed and an open command station is provided for toy play as assisted by the imagination of the child. The actuator 30 also releases (not shown) the lower housing member 6 which permits the bias of the spring 32 to drive the lower housing member 6 outward from the base member 4. The timing mechanism disclosed in FIG. 4, however, controls this movement to a predetermined time, for example, five seconds. During the movement of the lower housing member, the respective firing levers 56 and 58 are activated by the camming action of the abutment members 52 and 54 which permit the respective missiles 48 and 50 to be fired. Subsequently, the miniature vehicle 60 is also released to be projected from the toy vehicle 2. The child thus perceives the firing of the two missiles as a prelude to the release of either an escape or exploratory miniature vehicle 60.

What is described above is a spring-powered space vehicle which can initially provide a space theme vehicle configuration that is not only open to an expanded simulated space play toy, but also projects missiles and vehicles in a controlled manner. It will be readily apparent to those skilled in the toy manufacturing field that various modifications of the present invention are possible, and accordingly, the scope of the present invention should be interpreted solely from the following claims.

What is claimed is:

1. A space vehicle toy assembly comprising:

a base member;

means for movement of the base member across a support surface;

an upper housing member having movable wall members connected to the base member, the wall members being initially positioned to provide a closed encapsulated space for simulating a compartment for operators and alternatively being pivoted outward from the base member to provide a simulated opened command room with individual work areas for toy figures;

a lower housing member positioned beneath the upper housing member and relatively movable into or out of the base member;

means for firing projectiles on the lower housing member including a toy vehicle projectile;

means for biasing the wall members to an open position;

means for biasing the lower housing member to a position extended from the base member, and timing means for providing a controlled releasing of the lower housing member to move away from the base member and to carry the projectiles with the lower housing member until the lower housing member moves a predetermined distance away from the base member, the timing means further providing an immediate release of the wall members.

2. The invention of claim 1 wherein the movable wall members have a partial J-shaped cross sectional configuration.

3. A simulated space vehicle toy assembly comprising:

a base member;

an upper housing member having movable wall members connected to and positioned above the base member, the wall members capable of being positioned to provide a closed encapsulated space for simulating a compartment for an operator and alternatively being expanded to provide a simulated opened command room with individual work areas for toy figures that are accessible to a child for play action;

a lower housing member connected to the base member beneath the upper housing member and relatively movable to project into or out of the base member;

means for sequentially firing a plurality of projectiles from the lower housing member including a toy vehicle projectile;

means for biasing the lower housing member to an extended position from the base member, and means to release the lower housing member from the base member.

4. The invention of claim 3 further including timing means to control the movement of the lower housing member away from the base member in response to the biasing means for a predetermined time period.

5. The invention of claim 3 wherein the means for firing projectiles is activated by the movement of the lower housing means out of the base member.

6. The invention of claim 4 further including a pair of tractor treads connected to the base member.

7. The invention of claim 6 further including means for biasing the respective movable wall members to an open position.

8. The invention of claim 3 further including a second means for firing a projectile mounted on the base member and extending upward to project between the movable wall members in a closed configuration.

9. The invention of claim 3 further including projectiles in the form of rockets.

10. The invention of claim 3 wherein the movable wall members are respectively connected to parallel edges of the base member and extend vertically upward and across the base member for connection with the release means.

11. The invention of claim 3 wherein the timing means includes a rack and pinion gear, the rack being mounted on one of the base or lower housing members and the pinion gear mounted on the other member.

* * * * *